United States Patent [19]

Inoue

[11] Patent Number: 4,542,513

[45] Date of Patent: Sep. 17, 1985

[54] HEATER FOR HOT ISOSTATIC PRESSING APPARATUS

[75] Inventor: Yoichi Inoue, Hyogo, Japan

[73] Assignee: Kabushiki Kaisha Kobe Seiko Sho, Kobe, Japan

[21] Appl. No.: 520,711

[22] Filed: Aug. 5, 1983

[30] Foreign Application Priority Data

Aug. 7, 1982 [JP] Japan ..... 57-120080[U]

[51] Int. Cl.[4] ..... F27D 11/00; F27D 7/02

[52] U.S. Cl. ..... 373/112; 373/111; 373/117; 373/128

[58] Field of Search ..... 373/110, 111, 112, 117, 373/128, 132, 130

[56] References Cited

U.S. PATENT DOCUMENTS 3,470,303 9/1969 Lundström ..... 373/110
4,268,708 5/1981 Smith, Jr. et al. ..... 373/112

FOREIGN PATENT DOCUMENTS 1178677 3/1966 United Kingdom .
1117776 6/1968 United Kingdom ..... 373/110

*Primary Examiner*—Reinhard J. Eisenzopf
*Assistant Examiner*—Gregory D. Thompson
*Attorney, Agent, or Firm*—Oblon, Fisher, Spivak, McClelland & Maier

[57] ABSTRACT

A stacked type heater construction particularly suitable for large HIP apparatus, having a number of heating unit assemblies stacked one on another to provide a vertical series of independently controllable heating zones, the heater including a generally cylindrical heater retaining cage constituted by a number of annular graphitic members serving as girdle frames and a number of graphitic support columns serving as vertical frames, the annular members and support columns being connected with each other through electric insulators and defining a series of divided sections around the heater retaining cage in each one of the heating zones; and a plurality of segmental graphitic heating elements supported in the respective divided sections of the heater retaining cage through electric insulators to form an independent heating circuit in each heating zone.

5 Claims, 9 Drawing Figures

HEATER FOR HOT ISOSTATIC PRESSING APPARATUS

BACKGROUND OF THE INVENTION

1. Field of the Invention

This invention relates to a heater construction particularly suitable for use in a hot isostatic pressing apparatus.

2. Description of the Prior Art

The use of graphite is rapidly spreading in the manufacture of heaters for hot isostatic pressing apparatuses (hereinafter referred to simply as "HIP apparatus" for brevity) which treat a workpiece or workpieces in a high temperature and pressure atmosphere by application of pressure and heat, because of the advantages accruing from (1) the excellent heat resistance of graphite heaters so as to realize the feasibility of operations in a higher temperature range with a longer service life and with less deterioration than the conventional metal heaters, and (2) far lower cost as compared with the metal heaters.

To cope with the recent trend toward larger HIP apparatuses which require a heater of larger dimensions in both vertical and radial directions, there have come into use the so-called stacked type heater constructions which incorporate a number of heating element units in stacked form instead of a heating element of a unitary or single structure.

This is because large unitary type heaters are difficult to produce and need to be divided into a plurality of heating zones of different capacities in order to prevent temperature variations between different positions in the vertical or longitudinal direction of the furnace chamber in a high pressure container.

The conventional graphite heaters generally incorporate a grid-like meandering heating element which is formed by cutting longitudinal slits alternately from the upper and lower ends of a cylindrical structure as shown in FIG. 7(*a*), or by connecting round rods and flat strips into a zig-zag form as shown in FIG. 7(*b*). In the fabrication of a stacked type heater, it is the general practice to stack a number of such cylindrical heating unit structures through an annular electric insulator of a unitary or composite structure.

Such heater construction is suitable for a small HIP apparatus but not for a large HIP apparatus in view of the mechanical instability of the heating element 3′ of graphite which is required to serve as the base structure of the heater, coupled with the economical problem that the cost of the apparatus is increased due to the necessity of providing a greater number of electric insulators 7. The application to a large industrial HIP apparatus is further limited by a problem concerning maintenance and service that the heater has to be disasembled almost in its entirety at the time of replacement of the heating elements.

SUMMARY OF THE INVENTION

It is an object of the present invention to eliminate the difficulties or problems which are encountered in promoting the application of the large stacked type heater construction to the actual HIP apparatus.

It is a more particular object of the present invention to provide a graphite heater construction for use in HIP apparatus, which is improved in mechanical stability and which facilitates maintenance and service.

In order to achieve these objectives, the present invention provides a heater of the stacked type construction particularly suitable for a large HIP apparatus, having a number of heating unit assemblies stacked one on another to vertically provide a series of independently controllable heating zones, the heater comprising a generally cylindrical heater retaining cage constituted by a number of annular graphitic members serving as girdle frames and a number of graphitic support columns serving as vertical frames, the annular members and support columns being connected with each other through electric insulators and defining a series of divided sections around the heater retaining cage in each one of the heating zones; and segmental graphitic heating elements supported in the respective divided sections of the heater retaining cage through electric insulators to form an independent heating circuit in each heating zone.

The above and other objects, features and advantages of the present invention will become apparent from the following description and appended claims, taken in conjunction with the accompanying drawings which show by way of example a preferred embodiment of the invention.

DETAILED DESCRIPTION OF THE PREFERRED EMBODIMENT

Figure 1:
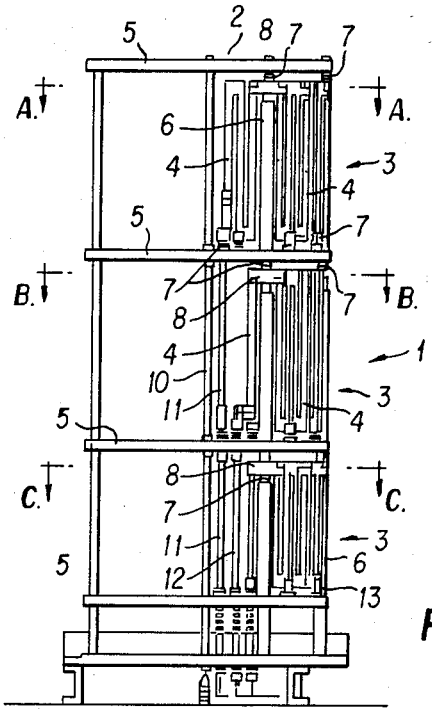
FIG. 1 is a partially front elevational view of a heater according to the present invention.

Referring to FIG. 1, there is shown by reference number 1 a heater for use in a furnace chamber of an HIP apparatus, the heater 1 being assembled into the form of an ordinary cylinder or polygonal cylinder and located concentrically within a cylindrical space of the furnace chamber in such a manner as to circumvent a workpiece or workpieces for heating the same uniformly by circumambient heating.

The heater 1 has a series of vertical heating zones 3 (upper, middle and lower heating zones in the particular example shown) which are independently controllable for the adjustment of calorific power, and is constituted by assembling a plurality of segmental heating elements 4 of graphite into a cylindrical form by the use of a heater retaining cage 2.

As is clear from FIGS. 1 to 5, the heater retaining cage 2 is constituted by a plurality of annular graphitic members 5 (four annular members being shown in the particular example illustrated) which serve as girdle frames, and a plurality of graphitic support columns 6 (six being shown in the example illustrated) which are passed through the annular members 5 at equidistant positions to serve as vertical frames, forming a frame assembly like a squirrel cage with six divided sections in each one of the upper, middle and lower heating zones, that is to say, 18 divided sections in total.

On the other hand, the graphitic heating elements 4 of zig-zag shape are supported in the respective sections defined by the girdle and vertical frame members 5 and 6 of the heater retaining cage 2 in an electrically insulated state by means of electric insulators 7. The segmental heating element 4 in each cage section may be constituted by a single continuous structure or alternatively by a couple of or more parts of similar shape which are electrically and mechanically connected by a connecting strip 9 as in the particular embodiment shown.

Figure 2:
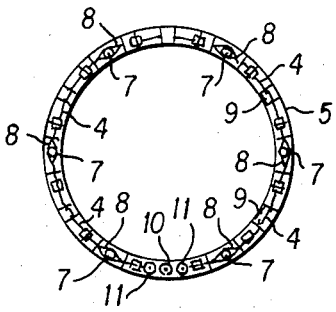
FIGS. 2 through 4 are sectional views taken along lines A—A, B—B and C—C of FIG. 1, respectively.
Figure 3:
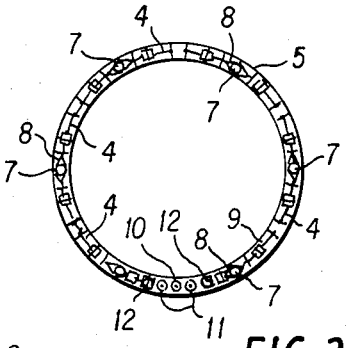
Figure 4:
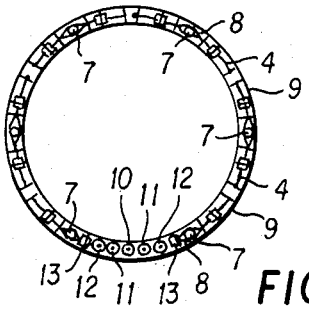

As shown in FIGS. 2 to 4, the segmental heating elements 4 are preferably disposed within a space defined by the vertical planes containing the inner and outer peripheral surfaces of the graphitic annular members 5 for securely supporting them on the insulators 7 in a facilitated manner and for minimizing the thickness of the heater 1 in the radial direction to realize the maximum effective use of the work-accommodating space in the high pressure container of the HIP apparatus.

As mentioned hereinbefore, the segmental heating elements 4 which are divided and allotted to the respective sections have to be electrically connected with each other such that an independent heater circuit is independently formed for each one of the stacked heater units. This can be attained by electrically connecting segments 4 of heating elements in laterally adjacent sections by flexible graphitic sheets 8 which are extended across the insulators 7.

Figure 6:
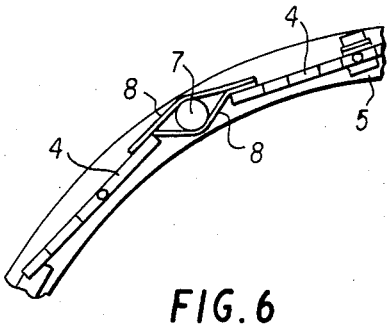
FIG. 6 is a fragmentary plan view showing the same part of the heater also on an enlarged scale.
Figure 7A:
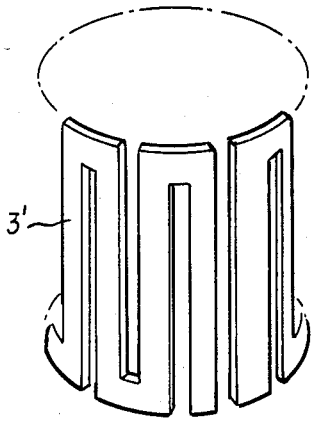
FIG. 7a PRIOR ART
FIGS. 7(*a*) and 7(*b*) are fragmentary perspective views of conventional heaters.
Figure 7B:
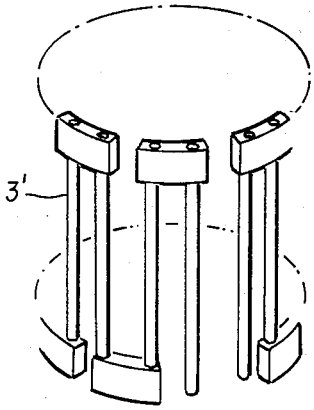
FIG. 7b PRIOR ART
Figure 8:
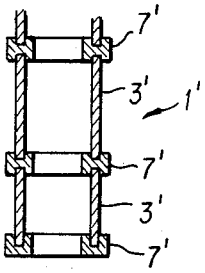
FIG. 8 is a schematic view of a conventional stacked type heater construction.

As shown particularly in FIG. 6, a pair of the flexible graphitic sheets 8 in the form of strips of a suitable length are passed embracingly on opposite sides of each insulator 7 and have opposite ends thereof simply and fixed to the end portions of the segmental heating elements 4 by bolts or other suitable fixing means.

With the above-described arrangement, the errors which occur in the manufacturing process or by thermal distortion of a large-sized heater can be absorbed by the flexible graphite sheets.

The heating zones 3 which are obtained by connecting the segmental heating elements 4 of the respective heater unit by the use of the flexible graphite sheets 8 in this manner have respective terminal ends thereof electrically and mechanically connected to potentializing electrodes 11 to 13 which extend through the annular members 5 with electrical insulation symmetrically on opposite sides of thermocouples 10 which are also passed through the annular members 5.

Figure 5:
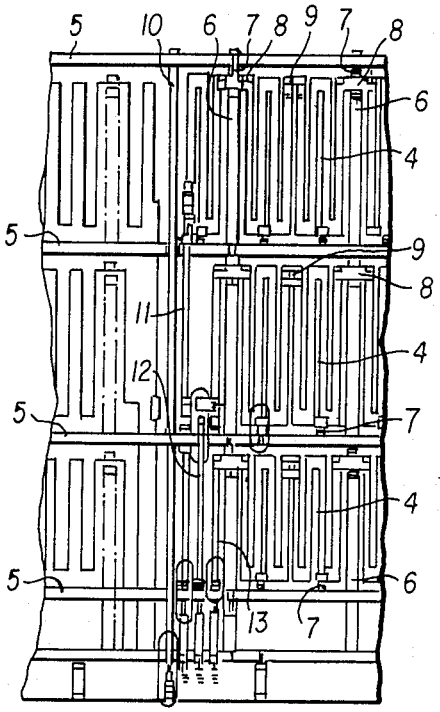
FIG. 5 is a developed front view showing part of the heater construction of the invention on an enlarged scale.

As is clear from the developed view of FIG. 5, the separably connected segmental heating elements 4 of the respective sections can be retained in a mechanically stable state in the insulators 7 which are mounted on top of the annular member 5. In this case, the insulators 7 suffice to be provided at suitable intervals as shown in the drawing.

Aside from the above-mentioned fixing means, it is of course possible to suspend the segmental heating elements 4 by the electric insulators 7 fixed on the graphitic annular members 5 which are located immediately above the segmental heating elements 4, or by the electric insulators 7 which are fixedly secured to the graphitic support columns 6. In the particular embodiment shown, the upper end portions of the segmental heating elements 4 are supported substantially simultaneously by the support columns 6 and the upper annular members 5 over the respective heating units, through the electric insulators 7 which are provided at the joints of the support columns 6 and the annular members 5 and which are held between the flexible graphite sheets 8.

Further, in the embodiment shown, the segmental heating elements 4 are also supported on the lower side by the electric insulators 7 which are fixed on the annular members 5 located immediately beneath the heating elements 4 to provide stable and secure mechanical support therefor. Nevertheless, the segmental heating elements 4 in the respective sections can be easily independently detached for replacement or for other purposes.

As is clear from the foregoing description, the heater construction according to the present invention has the segmental heating elements retained in the vertical and girdle frames which constitute a cage 2 of high mechanical and thermal strength, so that there can be obtained a heater construction with a large dimensional diameter and height which can hold the heating elements in an extremely stable state.

The graphitic heating elements 4 are divided into segments which are supported in the respective sections partitioned by the annular members 5 and support columns 6 through the electric insulators 7, and electrically and mechanically connected with the segments in the adjacent sections by flexible graphitic sheets 8. Therefore, the segmental heating elements 4 in the respective sections can be easily detached independently of each other at the time of replacement or the like.

Further, the flexible graphite sheets 8 which connect the segmental heating elements 4 serve to absorb the errors which might occur in the course of fabrication of large heaters as well as the thermal deformations.

Moreover, the heater construction of the present invention suffices to employ a reduced number of small electric insulators 7 for supporting the segmental heating elements 4, contributing to the production cost of the heater by saving the electric insulator and at the same time permitting design of the heater in such a manner as to preclude the damage which might be caused to either a heating element 4 or an insulator 7 by the thermal stress resulting from the difference in thermal expansion coefficient, to thereby improve the mechanical stability of the heater further.

It will be appreciated from the foregoing description that the heater construction according to the present invention can maintain mechanical stability over a long time period and is extremely useful for promoting the fabrication of heaters of larger sizes at an appropriate production cost, in addition to the effects of improving to a significant degree the convenience and efficiency of the maintenance and service which are important to a manufacturing apparatus, particularly to a heater of an HIP system.

Obviously, numerous modifications and variations of the present invention are possible in light of the above teachings. It is therefore to be understood that within the scope of the appended claims, the invention may be practiced otherwise than as specifically described herein.

What is claimed is:

1. A heater for a hot isostatic pressing apparatus for treating at least one workpiece in a high temperature and pressure gas atmosphere by application of heat and pressure, comprising:

a stacked type heater having a plurality of heating element assemblies stacked one on another to form a vertical series of independently controllable heating zones;

a generally cylindrical heater retaining cage having a plurality of annular graphitic members serving as girdle frames, a plurality of graphitic support columns serving as vertical frames, and a plurality of electric insulators connecting said annular members and support columns with each other and defining a series of divided sections around said heater retaining cage in each one of said heating zones; and a plurality of segmental graphitic heating elements supported in the respective divided sections of said heater retaining cage and extending between said plurality of insulators so as to form an independent heating circuit in each heating zone wherein said segmental heating elements are disposed in a space defined by a plurality of vertical planes containing inner and outer peripheries of said plurality of annular graphitic members.

2. The heater as set forth in claim 1, further comprising a plurality of flexible graphitic sheets extended across said graphitic support columns and passing on opposite sides of each of said insulators wherein said plurality of segmental heating elements in adjacent sections of said heater retaining cage are electrically mounted with each other by said flexible graphitic sheets.

3. The heater as set forth in claims 1 or 2, wherein said plurality of electric insulators are each fixed on a respective annular graphitic member of said plurality of annular graphitic members that are located immediately beneath said segmental heating elements.

4. The heater as set forth in claims 1 or 2, wherein said electric insulators are fixed on an annular graphitic member located immediately above said segmental heating elements and wherein said segmental heating elements are supported in suspension by said plurality of electric insulators.

5. The heater as set forth in claims 1 or 2, further comprising a plurality of electric insulators fixed on graphitic support columns located on lateral sides of said segmental heating elements wherein said segmental heating elements are supported by said plurality of electrical insulators.

* * * * *